US009239211B2

(12) United States Patent
Percival

(10) Patent No.: US 9,239,211 B2
(45) Date of Patent: Jan. 19, 2016

(54) STABILISATION OF FIREARMS

(71) Applicants: Herman Albertus Percival, Gauteng Province (ZA); Daniel Eastes, Mpumalanga (ZA)

(72) Inventor: Herman Albertus Percival, Gauteng Province (ZA)

(73) Assignee: Daniel E. Eastes, Nelspruit (ZA)

( * ) Notice: Subject to any disclaimer, the term of this patent is extended or adjusted under 35 U.S.C. 154(b) by 0 days.

(21) Appl. No.: 14/026,287

(22) Filed: Sep. 13, 2013

(65) Prior Publication Data

US 2015/0075055 A1 Mar. 19, 2015

(51) Int. Cl.
*F41A 23/08* (2006.01)
*F41C 33/00* (2006.01)

(52) U.S. Cl.
CPC ..... *F41C 33/001* (2013.01); *F41A 23/08* (2013.01)

(58) Field of Classification Search
CPC ..... F41A 23/10; F41A 23/08; F41A 23/06; F41A 23/02; F41A 23/12; F41A 23/14; F41C 33/001
USPC ..... 42/94, 72; 89/37.04; 369/419; 124/25
See application file for complete search history.

(56) References Cited

U.S. PATENT DOCUMENTS

| | | | | | |
|---|---|---|---|---|---|
| 74,119 | A * | 2/1868 | Muller | F41C 23/02 | 42/36 |
| 2,441,487 | A * | 5/1948 | Howard | F41C 23/04 | 42/72 |
| 2,552,205 | A * | 5/1951 | Moss | F16M 13/04 | 224/259 |
| 2,771,826 | A | 1/1955 | Shapiro | | |
| 3,191,826 | A | 6/1965 | Adams | | |
| 3,200,528 | A * | 8/1965 | Christensen | F41C 23/12 | 224/185 |
| 3,390,477 | A | 7/1968 | Galbraith | | |
| 4,844,390 | A | 7/1989 | Duke | | |
| 5,377,437 | A * | 1/1995 | Underwood | F41A 23/06 | 42/94 |
| 5,528,846 | A * | 6/1996 | Baggett | F16M 13/04 | 224/913 |
| 5,735,496 | A * | 4/1998 | Dube | F41C 33/001 | 248/118 |
| 5,738,256 | A | 4/1998 | Goff | | |
| 5,819,461 | A | 10/1998 | Killian | | |
| 5,930,931 | A | 8/1999 | Watson | | |
| 6,082,034 | A | 7/2000 | Musmanno | | |
| 6,764,231 | B1 * | 7/2004 | Shubert | F16M 13/04 | 396/419 |
| 6,889,465 | B1 | 5/2005 | Holmes | | |
| 8,763,297 | B2 * | 7/2014 | Boll | A01M 31/02 | 42/94 |

(Continued)

FOREIGN PATENT DOCUMENTS

| | | |
|---|---|---|
| EP | 1826524 | 12/2009 |
| GB | 2366857 | 5/2004 |

*Primary Examiner* — Samir Abdosh
*Assistant Examiner* — John D Cooper
(74) *Attorney, Agent, or Firm* — Yancy IP Law, PLLC

(57) ABSTRACT

A body-mountable firearm support assembly that is mountable to the body of a user to support a firearm in a stable configuration in use includes a first elongate support that is supportable, in use, at a first support zone on the body of the user in an operatively forwardly projecting configuration and a second elongate support that is supportable, in use, at a second support zone on the body of the user. The second support zone is lower on the user's body than the first support zone. The second elongate support is connected to the first elongate support at a third support zone spaced, in use, from the first and second support zones along the first and second supports. The assembly also includes an anchoring formation that is wearable, in use, by the user such that it provides the second support zone.

1 Claim, 4 Drawing Sheets

(56) References Cited

U.S. PATENT DOCUMENTS

2005/0262753 A1* 12/2005 Lahti ..... F41C 23/12
42/94
2006/0288625 A1* 12/2006 Williams ..... F41A 17/54
42/70.11
2007/0068501 A1* 3/2007 Bednar ..... F41B 5/123
124/25
2010/0251592 A1 10/2010 Otto
2013/0167424 A1* 7/2013 Nail ..... F41A 23/06
42/94

* cited by examiner

STABILISATION OF FIREARMS

FIELD OF THE INVENTION

THIS INVENTION relates to the stabilisation of firearms in use. More particularly, the invention relates to supporting a firearm, and particularly a rifle, in a stable configuration in use. The invention provides a body-mountable firearm support assembly and extends to a firearm support kit for providing a body-mountable firearm support assembly.

BACKGROUND TO THE INVENTION

Firearm supports are widely used to support firearms in stable configurations in use, i.e. when a shot is to be taken. Typically, in the Applicants' experience, such use is by casual hunters. Generally, two types of supports can be distinguished, namely ground-mounted supports and body-mounted supports. The nature of each of these is as its name infers.

The Applicants have experienced difficulties with ground-mounted supports in that these do not allow much freedom of movement once aim has been taken, and in that it is generally necessary to reposition the support before re-taking aim, or to reposition the rifle on the support by removing it from and then replacing it on the support.

The Applicants have also experienced difficulties with body-mounted supports, in that these, although allowing freedom of movement, do not always provide a desired degree of stability.

With the present invention, the Applicants therefore seek to address and alleviate the abovementioned difficulties.

SUMMARY OF THE INVENTION

IN ACCORDANCE WITH ONE BROAD ASPECT OF THE INVENTION, there is provided a body-mountable firearm support assembly that is mountable to the body of a person or user to support a firearm in a stable configuration in use, the support assembly including

- a first elongate support that is supportable, in use, at a first support zone on the body of the person or user in an operatively forwardly projecting configuration;
- a second elongate support that is supportable, in use, at a second support zone on the body of the person or user, with the second support zone being lower on the person or user's body than the first support zone and with the second elongate support being connected to the first elongate support at a third support zone, which is spaced, in use, from the first and second support zones along the first and second supports; and
- an anchoring formation that is mountable, in use, to the person or user such that it provides the second support zone, with the second elongate support thus being supportable, in use, by the body of the person or user by means of the anchoring formation.

The second elongate support may thus be connected or connectable, in use, to the anchoring formation and thereby be rendered supportable, in use, by the body of the person or user.

The third support zone may, naturally, be spaced from the user's body.

The first and second elongate supports may each comprise an elongate support member, preferably a tubular member. Preferably, the support members are of metallic material, typically comprising hollow steel tubing. In such a case, the first and second supports may therefore provide a support frame that is supportable on the body of the person or user.

The elongate supports may each conveniently have a length of about 1 meter. Alternatively, one of the elongate supports, typically the first elongate support, may be slightly longer than the other elongate support.

Connection of the first and second elongate supports to each other may be such that they are angularly spaced, or capable of being angularly spaced, relative to each other. Preferably, connection of the first and second elongate supports to each other is such that they are pivotally displaceable relative to each other. Connection of the first and second elongate supports may be adjacent operatively distal and ends thereof, which distal ends are free, in use, from the body of the person or user.

The first support zone may be provided, in use, by a shoulder of the person or user. Thus, the first elongate support may be supportable, in use, on a shoulder of the person or user. In such a case, the assembly may include a shoulder mount, by which the first elongate support is mountable, in use, to the shoulder of the person or user.

The second elongate support zone may be provided at the waist of the person or user. Thus, the second elongate support may be supportable, in use, at a waist of the person or user. It will be appreciated that the anchoring formation may therefore be wearable by the person or user at the person or user's waist. In such a case, the anchoring formation may be provided by an anchoring device and may have one or more mounting members by which it is mountable to the waist of the person or user. Preferably, the mounting members render the mounting device, and thus the mounting formation, mountable to a waist belt of the person or user. In such a case, the mounting members may typically comprise one or more loops through which the person or user's waist belt can be threaded, in use.

The second elongate support, and possibly alternatively the first elongate support with the first and second supports thus being functionally interchangeable, may be pivotally mounted or mountable, in use, to the anchoring formation. In one embodiment of the invention, the second elongate support, and possibly also the first elongate support, such that the first and second elongate supports are functionally interchangeable, may have an attachment formation that is pivotally received or receivable, in use, by the anchoring formation such that the second elongate support is pivotally displaceable, in use, in and in relation to the anchoring formation. Thus, in use, the second elongate support may also be pivotally displaceable relative to the person or user and thus not be fixed in orientation relative to them, but capable of moving, in use, about a pivot axis at the second support zone. The attachment formation may be provided at a proximal end of the second elongate support. In a particular embodiment of the invention, one of the attachment formation and the anchoring formation may comprise a bulbous member, with the other one comprising a socket in which the bulbous member is pivotally receivable.

The assembly may also include, on the support member on which the firearm is, in use, supported, a cushioned section being provided with cushioning. The cushioning may be applied such that, in use, the firearm can rest on the cushioning. This is expected to assist both in protecting the firearm and the support member, and further also to avoid loud, sharp sounds that made result from the firearm contacting the support member.

The support members may, in some embodiments of the invention, be telescopic and thus extendible.

IN ACCORDANCE WITH ANOTHER, MORE SPECIFIC, ASPECT OF THE INVENTION, there is provided a body-mountable firearm support assembly that is mountable to the body of a person or user to support a firearm in a stable configuration in use, the support assembly including

- a first elongate support member that is supportable, in use, along its length on a shoulder of the person or user in an operatively forwardly projecting configuration;
- a second elongate support member that is supportable, in use, at a proximal end thereof at the waist of the person or user, with the first and second elongate support members being pivotally connected to each other adjacent distal ends thereof; and
- a anchoring formation that is mountable, in use, to the person or user at their waist and to which the proximal end of the second elongate support member is pivotally connected or connectable, in use.

THE INVENTION EXTENDS TO a firearm support kit for providing a wearable firearm support assembly as hereinbefore described.

BRIEF DESCRIPTION OF THE DRAWINGS

The invention will now be described in more detail by way of example, with reference to the accompanying diagrammatic drawings.

In the drawings

DETAILED DESCRIPTION OF THE INVENTION

Figure 1:
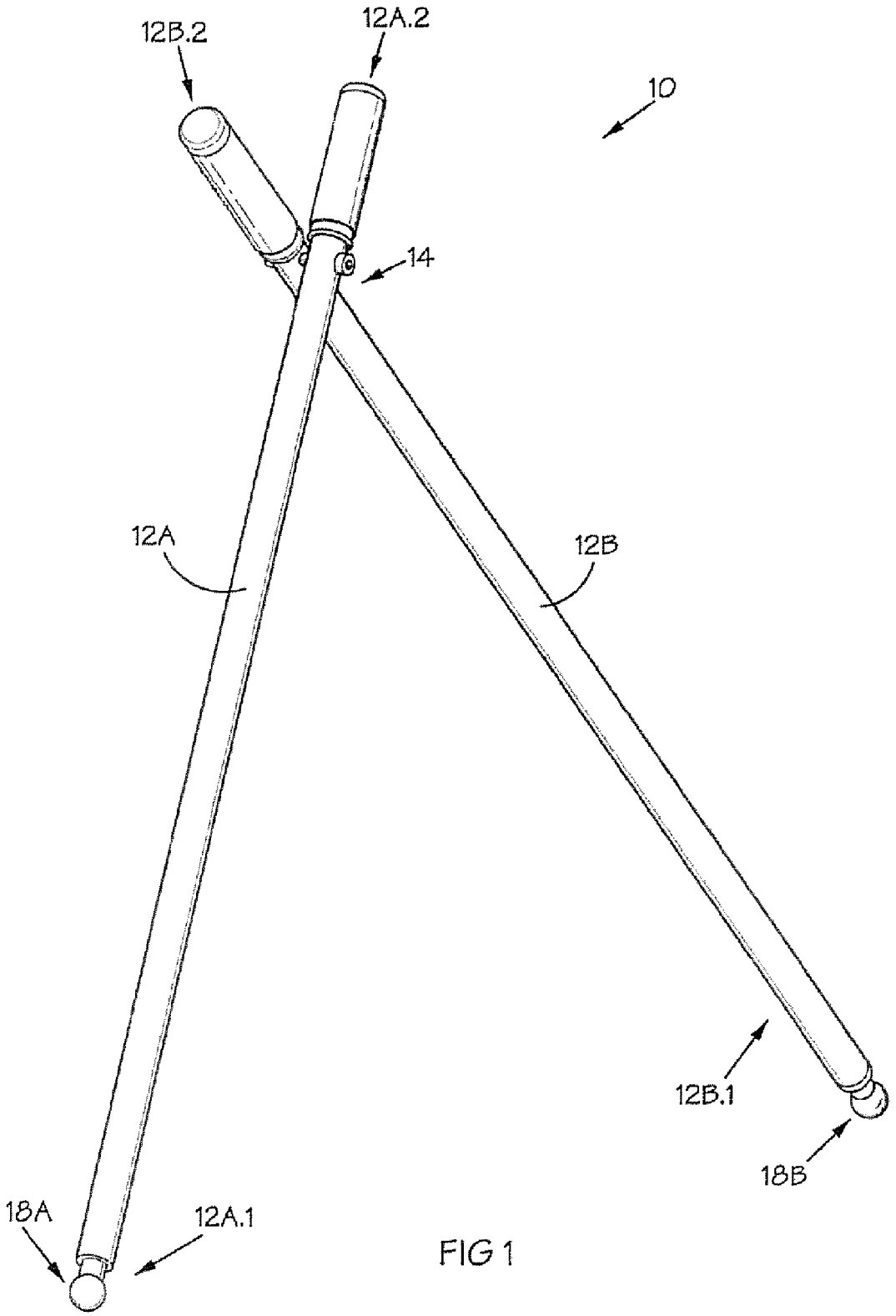
FIG. 1 shows a support frame of a firearm support assembly in accordance with the invention.
Figure 3:
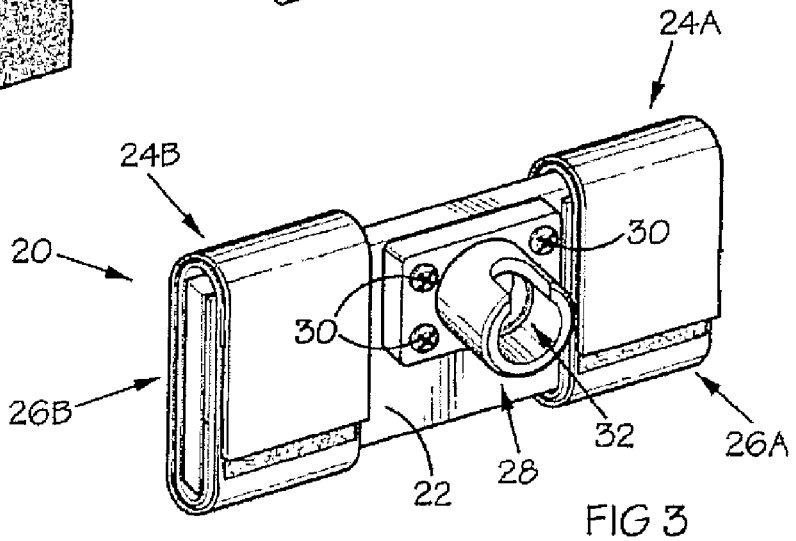
FIG. 3 show the anchoring device of FIG. 2 in a closed configuration.

Referring to the drawings and in particular to FIG. 1, reference numeral 10 generally indicates a support frame of a firearm support assembly in accordance with the invention (and as illustrated more clearly in FIG. 3, designated by reference numeral 100).

The support frame 10 comprises first and second elongate support members 12A, 12B, each being tubular and being of a metallic material. The support members 12A, 12B are of equal length, being about 1 meter. It will be appreciated that, in accordance with the invention, the first support member 12A may be longer than the second support member 12B.

Each of the support members 12A, 12B has a proximal end 12A.1, 12B.1 and a distal end 12A.2, 12B.2.

The support members 12A, 12B are pivotally connected to each other at a connection point 14 along their lengths and adjacent to, i.e. more closely spaced to, their distal ends 12A.2, 12B.2. The connection point 14 comprises a bolt 16 which extends through both support members 12A, 12B, thus attaching them to each other. In passing from the first support member 12A to the second support member 12B, the shaft of the bolt 16 passes through a spacing sleeve (not visible) which spaces the support members 12A, 12B from each other and maintains their pivotability relative to each other.

At the proximal end 12A.1, 12B.1 of each support member 12A, 12B, is provided a bulbous connector 18A, 18B. As hereinafter described in more detail, the connectors 18A, 18B respectively render their associated support member 12A/12B pivotally mountable at a second support zone on the body of a person or user using the support frame 10 as part of a support assembly in accordance with the invention.

Figure 2:
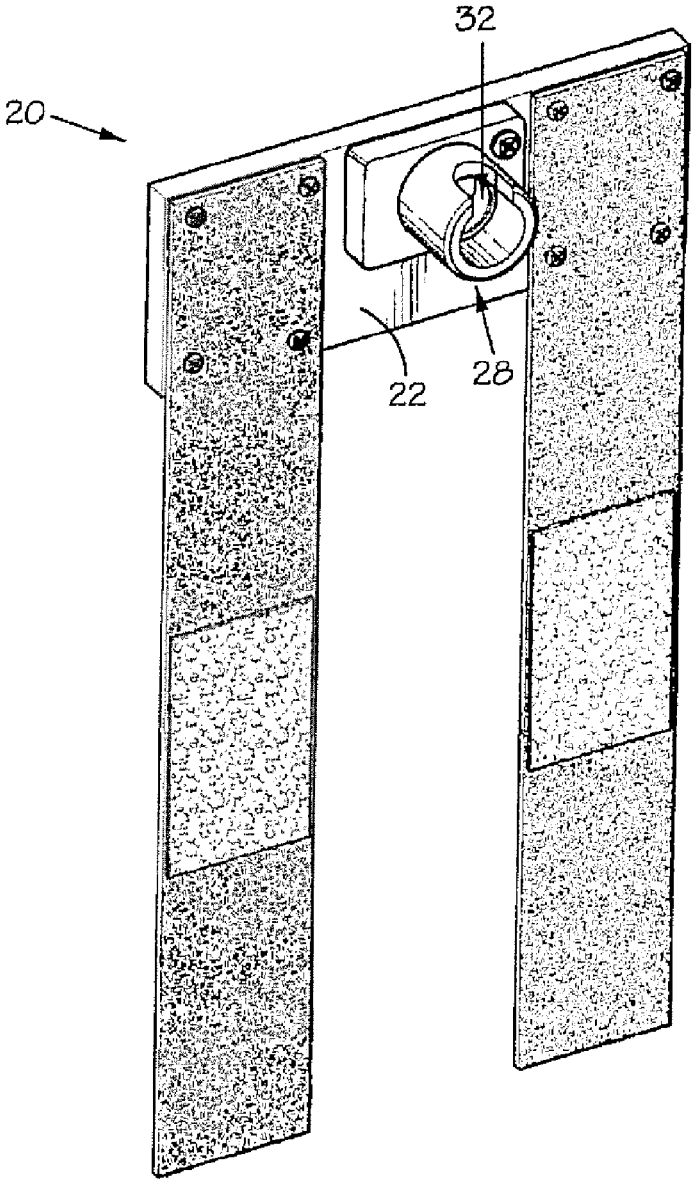
FIG. 2 shows an anchoring device of a firearm support assembly in accordance with the invention in an open configuration.

Referring now to FIGS. 2 and 3, reference numeral 20 generally indicates an anchoring device of a firearm support assembly in accordance with the invention. The device 20 comprises a base 22 which is rectangular and of a planar metallic material. Velcro® straps 24A, 24B are attached to respective end portions 26A, 26B of the base 22 and are wrapped around these portions 26A, 26B. The straps 24A, 24B provide mounting members, being capable of providing loops which render the base 22 and thus the device 20 attachable to a waist belt of a person or user using the assembly in accordance with the invention.

The device 20 further comprises an anchoring formation 28 that is attached to the base 22 by means of bolts 30. The formation 28 comprises a socket and defines an anchoring cavity 32 in which the connectors 18A, 18B are severally receivable with an interference fit, thereby to mount their associated support members 12A, 12B to the device 20 and render their associated support members 12A, 12B pivotally displaceable relative to the device 20.

Figure 4:
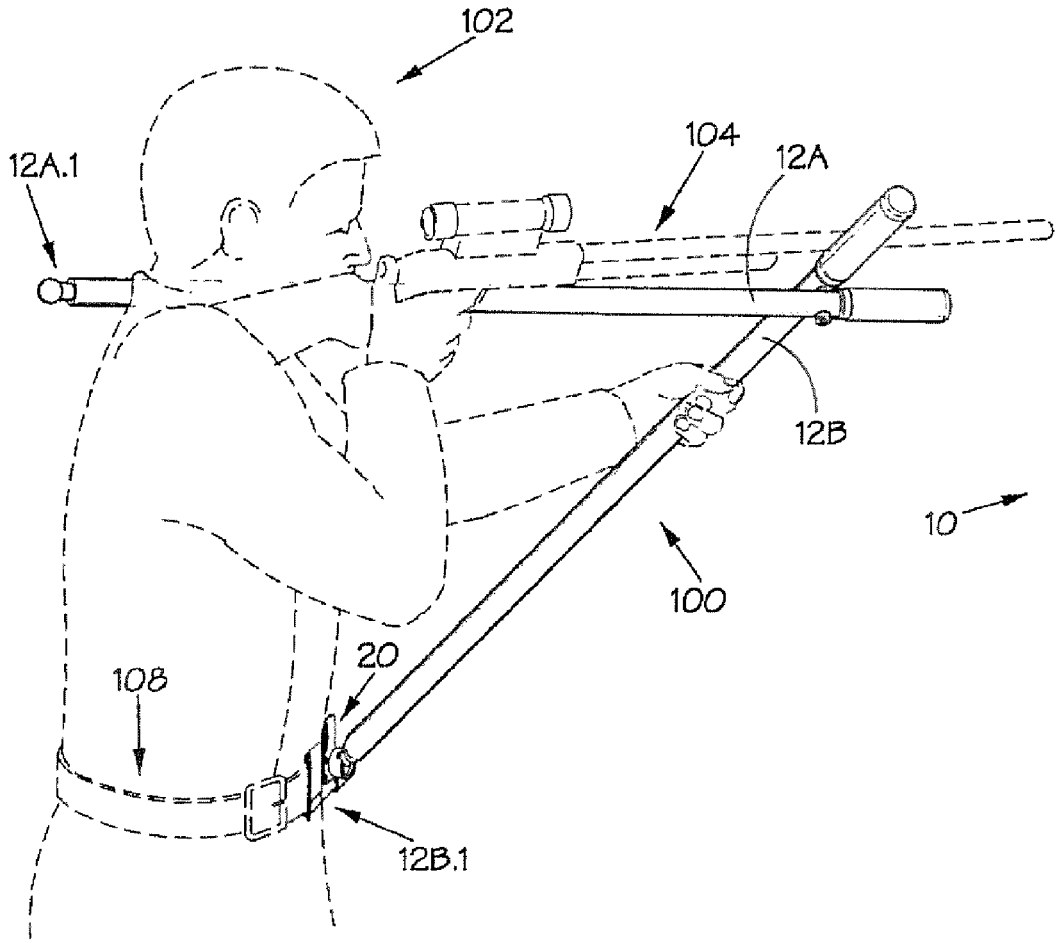
FIG. 4 shows a support assembly, comprising the support frame of FIG. 1 and the anchoring device of FIGS. 2 and 3, in use.

In FIG. 4, the frame 10 and device 20 comprise a firearm support assembly 100 in accordance with the invention, the assembly 100 being mounted to a person or user 102 using a firearm comprising a rifle 104. The same reference numerals used in FIGS. 1 and 2 in describing the frame 10 and device 20 are used in FIG. 3 to describe the working thereof.

The device 10 is attached by means of the Velcro® straps 24A, 24B to a waist belt 108 worn by the user 102 with the anchoring formation 28 protruding operatively forwardly therefrom and the device 10 thereby providing a second support zone on the body of the user 102.

The second support member 12B is proximally connected, at its proximal end 12B.1, to the anchoring formation 28 in the manner hereinbefore described, i.e. with the bulbous connector 18B thereof mounted inside the anchoring cavity 32 with an interference fit and the second support member 12B thereby being pivotally displaceable relative to the device 20.

In the in use configuration of the assembly 100, the second support member 12B angles forwardly upwardly such that the connection point 14 is substantially level with the shoulders of the person or user 102. The first support member 12A is then oriented, i.e. pivotally displaced about the connection point 14, such that it is also substantially level with the person or user's shoulders and is then located, at a point along its length adjacent its proximal end, on a shoulder of the person or user 102, being a first support zone which is located above the second support zone on the body of the person or user 102.

It will be appreciated that the first support member 12A thus projects operatively forwardly from the person or user's shoulder on which it is located and thus supported. It will further be appreciated that the first support member 12A is thus supported, adjacent the proximal end thereof, by the shoulder of the person or user 102 on which it is located and, adjacent the distal end thereof, by the second support member 12B which, in turn is supported at the second support zone by the means of the device 10.

When the person or user 102 wishes to fire a shot with the rifle 104, the rifle 104 is supported on the first support member 12A as shown and is stabilised, being supported by a support structure comprising the assembly 100 that is supported at two points on the body of the user or person 102.

This is in contrast to conventional body-mountable firearm supports which, to the Applicants' knowledge, are conventially supported at only one point on the body of the person or user. In this Applicants' experience, such a conventional approach does not provide desired stability.

Figure 5:
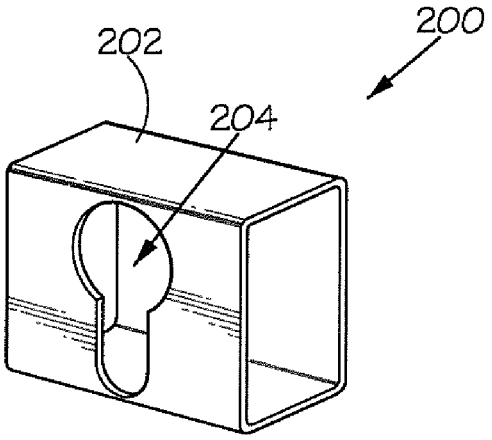
FIG. 5 shows, in three dimensional view, another embodiment of an anchoring device of a firearm support assembly in accordance with the invention.
Figure 6:
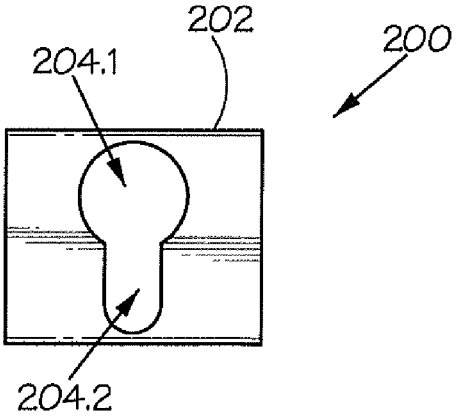
FIG. 6 shows the anchoring device of FIG. 5 in front view.

FIGS. 5 and 6 show another embodiment 200 of the anchoring device 20.

The anchoring device 200 comprises a hollow body 202. The body 202 has a rectangular cross section. The body 202 may, alternatively, have another cross sectional shape, although rectangular is preferred. At least, it is preferred that the body 202 is hollow, or at least defines a cavity, and has a substantially straight operatively rear face and a front face in which an aperture as hereinafter described can be defined to gain access the interior of the body.

The body 202 is longer than it is wide and high. The body 202 is also higher than it is wide. The body 202 may, however, also have the same width and height, or may be wider than it is high. In any event, it is preferred that the width of the body 202 approximates, but is greater than, diameters of the bulbous connectors 18A, 18B of the support members 12A, 12B such that either one of the bulbous connectors 18A, 18B can individually be received snugly within the interior width of the body 202.

The body is open at ends along its length. In one side face of the body 200 an aperture 204 is defined, granting access to the interior of the body 202. The interior of the body may also be regarded as a cavity. The aperture 204 is generally keyhole-shaped. A keyhole-shape is not strictly required, although it is preferred. Generally, however, an aperture that would be suitable as the aperture 204 must selectively, in one zone thereof, allow for insertion of one of the bulbous connectors 18A, 18B into the interior of the body 202 through the aperture and, in another zone thereof, disallow, obstruct and/or interfere with removal of the relevant bulbous connector 18A/18B from the body 202 through the aperture, thereby securing the relevant bulbous connector 18A/18B in position inside the body 202. With reference to FIG. 6 in particular, the aperture 204 has an access zone 204.1 and a securing zone 204.2. These zones 204.1, 204.2 serve respectively for either of the bulbous connectors 18A, 18B selectively (i) to access and (ii) to be securely lodged inside the interior of the body 202.

In use, for the user 102 to wear or carry the anchoring device 200 in substantially the same fashion in which the anchoring device 20 is worn or carried by the user 102 (with reference to FIG. 4), the waist belt 108 of the user 102 is threaded through the open ends of the body 202 such that the waist belt carries the anchoring device 200. The waist belt is then secured around the user's waist. In this manner, the anchoring device 20 is worn or carried by the user 102 on the user's waist. Orientation of the anchoring device 200 is such that the access zone 204.1 of the aperture 204 is operatively above the securing zone 204.2.

In using the frame 10 to provide another embodiment of the assembly 100 in which the anchoring device 200 replaces the anchoring device 20, the bulbous connector 18A, 18B of one of the support members 12A, 12B is inserted into the anchoring device 200 through the access zone 204.1. It will be appreciated that the access zone 204.1 is shaped complementally to the bulbous connectors 18A, 18B for the relevant bulbous connector 18A/18B freely to pass/be inserted into the interior of the body 202 through it. The support member 12A, 12B associated with the relevant bulbous connector 18A/18B is then displaced so as to move the bulbous connector 18A/18B operatively downward inside the anchoring device 200, such that it is thereby partly located operatively behind interior surrounds of the securing zone 204.2 with a narrowed portion thereof projecting operatively forwardly through the securing zone 204.2 to meet with and connect to its associated support member 12A/12B. In such a 'secured' configuration, the bulbous connector 18A/18B is obstructed by the surrounds in flange-like fashion from being removed from the anchoring device 200 in an operatively forward direction through the securing zone 204.2. In other words, the surrounds of the securing zone 204.2 interfere with removal of the bulbous connector 18A/18B from the body 202 through the aperture 204. It will be appreciated that side edges of the securing zone 204.2 are therefore more narrowly spaced than a spacing that is equal to the diameters of the bulbous connectors 18A, 18B. Notwithstanding the obstruction in the secured configuration, the bulbous connectors 18A, 18B would, in the secured configuration, remain free to move pivotally inside the body 202 insofar allowed by edges of the aperture 204, and particularly by the edges of the securing zone 204.2. In this manner, the support member 12A/12B associated with the relevant bulbous connector 18A/18B is also rendered pivotally displaceable relative to the anchoring device 200. As alluded to above, it will be appreciated that extremities, and particularly side edges, of the securing zone 204 would restrict movement of the relevant support member 12A, 12B. Such restriction would typically be to a single plane that extends operatively forwardly from the user, in use, and extends across a length of the securing zone 204.2. The embodiment of the assembly 100 which is thus provided is used in the same manner hereinbefore described with reference to FIGS. 1 through 4.

It has been found that the construction of the anchoring device 200 results in improved stability and safety of use of the firearm support assembly 100 in that the manner in which the bulbous connectors 18A, 18B are obstructed by surrounds of the securing zone 204.2 prevents the bulbous connectors 18A, 18B, and therefore necessarily the support members 12A, 12B from becoming inadvertently dislodged from the anchoring device 200, typically in an operatively forward direction, in use.

Essentially, the configuration explained above is based on an anchoring device that comprises a body defining an anchoring cavity that can be accessed by one of the bulbous connectors through a first, access zone of an access aperture thereto, with the bulbous connector being displaceable in the aperture to a second zone in which removal of the bulbous connector from the body through the aperture is obstructed.

The Applicants therefore believe that the present invention addresses and alleviates the difficulties associated with prior art firearm supports as hereinbefore outlined.

The invention claimed is:

1. A method of supporting a rifle in a stable configuration, the method including resting a first elongate support member of two elongate support members that are pivotally connected to each other adjacent distal ends thereof in a first support zone on top of one of a person's shoulders at a first support point along the length of the first elongate support member, the first support point being spaced along the first elongate support member from ends of the first elongate support member, such that the first elongate support member projects operatively forwardly from where it rests on the person's shoulder;

supporting a proximal end of a second elongate support member of the two elongate support members on a person's waist by connecting the proximal end to a single anchoring formation that is worn on the person's waist;

supporting a butt of the rifle against the person's other shoulder;

resting a stock of the rifle on top of the first elongate support member at a second support point along the length of the first support member, the second support point being spaced along the first elongate support member from ends of the first elongate support member and being spaced from the first support point, such that the rifle can be slidably displaced along the first elongate support member.

* * * * *